United States Patent [19]

Scheller

[11] Patent Number: 4,712,281

[45] Date of Patent: Dec. 15, 1987

[54] NAPPED WARP-KNITTED FABRIC AND METHOD OF PRODUCING SAME

[75] Inventor: Holger Scheller, Greensboro, N.C.

[73] Assignee: Guilford Mills, Inc., Greensboro, N.C.

[21] Appl. No.: 925,716

[22] Filed: Oct. 30, 1986

[51] Int. Cl.[4] ..... D06C 13/08

[52] U.S. Cl. ..... 28/162; 66/194

[58] Field of Search ..... 66/194, 191, 193, 85 R, 66/84 R; 28/162

[56] References Cited

U.S. PATENT DOCUMENTS

| | | | |
|---|---|---|---|
| 4,003,222 | 1/1977 | Wunner | 66/84 R |
| 4,302,953 | 12/1981 | Wilkens | 66/194 |
| 4,567,075 | 1/1986 | Krawczyk | 66/194 |

OTHER PUBLICATIONS

Darlington, K. D., "Analysis of Tricot Velour Fabrics", Knitting Times, Feb. 16, 1976, vol. 45, No. 7, pp. 33 to 37.

Darlington, K. D., "Tricot Brushed Velour Fabrics", Knitted Outerwear Times, Jun. 2, 1969, vol. 38, No. 28, pp. 43–47.

Reisfeld, A., "Warp Knit Fabrics and Products Part 17", Knitting Times, Feb. 22, 1971, vol. 40, No. 8, pp. 38–48.

*Primary Examiner*—Ronald Feldbaum

*Attorney, Agent, or Firm*—Shefte, Pinckney & Sawyer

[57] ABSTRACT

Warp knitted fabric of an at least two bar construction nappable on both fabric faces is produced on a warped knitted machine of at least three bar construction by utilizing a pile loop forming device on the bottom bar while simultaneously knitting a ground yarn substrate on the middle bar and knitting pile yarns on the top bar to be knitted into the substrate in needle loops at the technical fabric face and extended pile underlap loops at the technical fabric back. At least one surface of the fabric is napped, the extended underlap loops at the technical back being nappable to a plush surface effect while also being adapted to be partially drawn through the substrate to the technical face upon napping of the needle loops to produce a comparable plush surface at the technical face.

10 Claims, 20 Drawing Figures

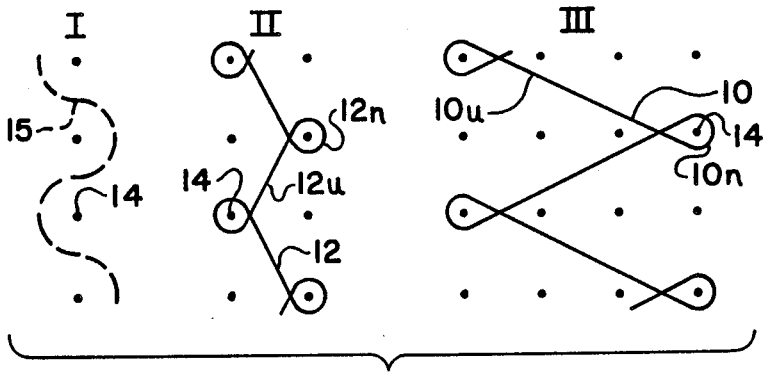
FIG. 9
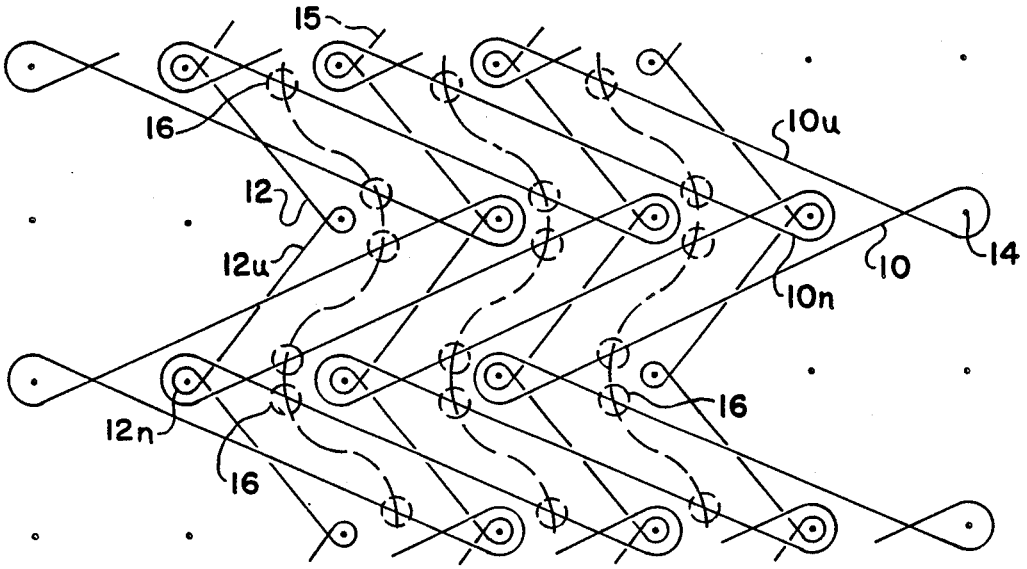
FIG. 10
FIG. 11
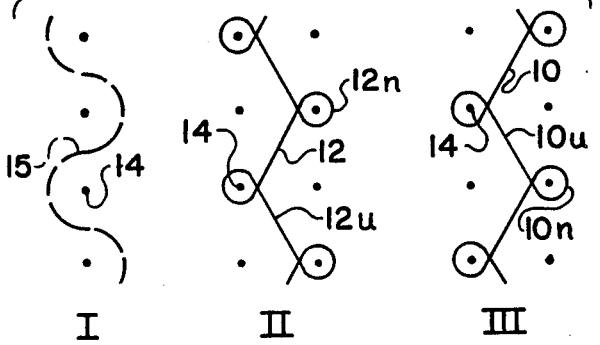

NAPPED WARP-KNITTED FABRIC AND METHOD OF PRODUCING SAME

BACKGROUND OF THE INVENTION

The present invention relates generally to napped fabrics and methods of producing same and, more particularly, to a warp-knitted fabric capable of being napped on both its technical face and technical back surfaces and a method of producing such fabric on a warp-knitting machine equipped with a pile loop forming device.

Napping is a conventional technique for producing a plush surface effect on textile fabrics by brushing the fabric surface, typically with rotating napping cylinders equipped with wire card clothing or another suitable brushing surface. Napping may be carried out as a finishing technique on many varying forms of woven and knitted textile fabrics, but normally it is considered necessary that the fabric have a suitable pile or other raised nappable surface extending from the woven or knitted fabric substructure so that napping can be accomplished without damaging or weakening the structural integrity of the fabric.

In warp-knitting technology, fabrics of a multi-bar construction having facing warp yarns interknitted into a ground yarn substrate to present extended floats, or "underlap" loops, of the facing yarn on the technical back of the fabric have conventionally been considered well adapted for napping on the technical back in that the float or underlap structure may be readily worked by napping cylinders without engaging the fabric substrate. However, at the opposite technical face of the fabric, the facing and substrate yarns are knitted in plated relationship which produces a desirably smooth technical face. As a result, it is normally undesirable to attempt to nap the technical face of the fabric since the facing and substrate yarns are not sufficiently distinct to avoid potential damage to the substrate, although some commercial fabrics of this type have been produced with a fully nappd technical back and a lightly napped technical face to provide a dual-faced napped surface effect to the fabric, e.g., a fabric designated as "FLANNEL FLANNEL II" produced by the assignee of the present invention.

It is also known in warp knitting technology to knit multi-bar fabrics with a terry loop surface effect by "overfeeding" a facing yarn at a greater rate than the substrate ground yarns whereby the excess facing yarn is forced outwardly from the fabric substrate in the form of elongated terry-like loops appearing at the technical face of the fabric and, in the case of most two-bar fabrics, also at the technical back of the fabric. However, as is well known, the degree of yarn overfeeding is relatively restricted under conventional warp knitting technology by the need to maintain minimal levels of tension in the overfed yarn. Further, as a result, certain relatively strong filament yarns, e.g. polyester and nylon yarns, tend to resist overfeeding and cannot normally be knitted in this manner. At the same time, the relative degree of overfeeding of the facing yarn in relation to the ground yarn is further restricted if an extended underlap construction is utilized. Accordingly, terry-type warp knitted fabric produced by this overfeeding technique is conventionally considered unsuitable for napping on both the technical face and back of the fabric.

U.S. Pat. No. 4,567,075, to Krawczyk, discloses a specially designed warp knitted blanket fabric of a minimum three-bar construction which is capable of being napped on both the technical face and back of the fabric. Basically, the fabric includes three sets of warp yarns, a set of ground yarns forming a fabric substrate to provide longitudinal stability to the fabric, a first set of facing yarns overfed to form nappable terry-type loops on the technical face of the fabric, and a second set of facing yarns formed in relatively extended nappable floats or underlap loops on the technical back of the fabric while also providing lateral stability thereto. While this fabric solves the deficiency of the above-discussed fabrics in being nappable on only one surface, the requirement of three sets of warp yarns makes the fabric relatively thick so as to be generally unsuitable for most apparel or like uses other than as a blanket fabric as disclosed and, furthermore, requires considerably greater amounts of yarn thereby increasing the overall cost of the fabric.

In recent years, pile loop forming devices have come into widespread use as an attachment to warp knitting machines to permit the formation of underlap loops of an extended terry-like pile-type character. Essentially, these devices utilize a set of sinker members mounted to one yarn guide bar of a conventional multi-bar warp knitting machine to enable the underlap loops of the facing warp yarns fed by another guide bar of the machine to be formed over the sinker members to a precisely controlled pile height. An example of this type of pile forming device is disclosed in Wunner U.S. Pat. No. 4,003,222. Through the use of their sinker members, these pile forming devices are capable of forming extended underlap loops on the technical fabric back to a pile height substantially greater than is achievable on the technical fabric face through the above-described overfeeding technique, because the facing yarns are fed and retained over the sinker members under controlled tension. Accordingly, the extended underlap pile produced utilizing these devices uniquely provides sufficient pile height for shearing to achieve a velour or velvet-like surface effect on the technical back of the fabric while providing the same generally smoothly surfaced technical face as the above-described conventional warp knitted fabrics.

SUMMARY OF THE INVENTION

It is accordingly an object of the present invention to provide an improved warp knitted fabric nappable on both its technical face and back and an improved method of knitting such a fabric utilizing the aforedescribed pile loop forming device on a warp knitting machine.

Briefly described, the present fabric is of an at least two bar construction having a set of ground yarns warp knitted as a fabric substrate and set of pile yarns warp knitted into the fabric substrate in needle loops at the technical face of the fabric forming a first nappable surface and in elongated pile underlap loops at the technical back of the fabric forming a second nappable surface. The underlap loops of the pile yarns are nappable to produce a plush surface on the technical back of the fabric and are further adapted to be partially drawn sufficiently from the technical back of the fabric through the substrate to the technical face of the fabric into the needle loops upon napping of the needle loops to render them nappable to produce a plush surface at the technical face of the fabric of a comparable thickness to the technical back of the fabric.

The present fabric may be formed in several embodiments with only the first nappable surface napped, or only the second nappable surface napped, or with both surfaces napped. With only the first nappable surface napped, the fabric has a plush surface on its technical face with an unnapped terry loop surface on its technical back. In a similar embodiment, the first nappable surface is napped only to the extent necessary to produce a raised loop terry-like surface effect on the technical face of the fabric to provide the fabric with a dual-faced terry pile construction. When only the second nappable surface is napped, the fabric has a plush surface on its technical back with a substantially smooth non-pile surface on its technical face. When both nappable surfaces are napped, the underlap loops are sufficiently drawn from the technical back of the fabric to the technical face to produce plush surfaces of comparable thicknesses on both faces of the fabric.

Preferably, the ground yarns of the fabric are relatively finer denier monofilament yarns to enhance the structural strength and integrity of the substrate while the pile yarns are relatively heavier denier multi-filament yarns to provide an enhanced plushness to the nappable surfaces. In a preferred embodiment of the fabric, the ground yarns are knitted in a 1,0-1,2 stitch pattern with the pile yarns being knitted in a 1,0-0,1 chain stitch pattern. As desired, a second set of ground yarns may be warp knitted as a second fabric substrate in a different stitch pattern from the first set of ground yarns. Similarly, a second set of pile yarns may be warp knitted into the fabric substrate in a different stitch pattern from the first set of pile yarns, Alternatively, a second set of pile yarns of a differing characteristic from the first set of pile yarns may be warp knitted into the fabric substrate in an alternating relationship with the first set of pile yarns to provide a patterned effect in the fabric.

The knitting method of the present invention is carried out on a warp knitting machine having at least top, middle and bottom yarn guide bars with the aforedescribed pile loop forming device or another suitable pile loop forming arrangement mounted on the bottom bar. The set of ground yarns is warp knitted on the middle bar of the machine to form the fabric substrate while the set of pile yarns is simultaneously knitted on the top bar and over the pile loop forming device on the bottom bar to knit the pile yarns into the substrate in needle loops at the technical face of the fabric forming the first nappable surface and in elongated pile underlap loops at the technical back of the fabric forming the second nappable surface. Following knitting, at least one of the nappable surfaces is napped to produce a plush fabric surface.

BRIEF DESCRIPTION OF THE DRAWINGS

FIG. 9 is another diagram similar to FIG. 1 showing individually the stitch patterns of the ground and pile yarns and the cooperative pattern of the pile loop forming device carried out by a warp knitting machine in knitting a second embodiment of the present fabric according to the method of the present invention, and FIG. 10 is a composite diagram thereof;

FIG. 11 is another diagram similar to FIG. 1 individually showing the stitch patterns of the ground and pile yarns and the cooperative pattern of the pile loop forming device carried out by a warp knitting machine in knitting a third embodiment of the present fabric according to the method of the present invention.

DESCRIPTION OF THE PREFERRED EMBODIMENT

As explained more fully herein, the method of the present invention is carried out on a warp knitting machine which may be of any conventional type of an at least three bar construction having three or more yarn guide bars and a needle bar, e.g., a conventional tricot warp knitting machine. The construction and operation of such machines are well known in the knitting art and need not herein be specifically described and illustrated.

In the following description, the yarn guide bars of the knitting machine are identified as "top," "middle" and "bottom" guide bars for reference purposes only and not by way of limitation. As those persons skilled in the art will understand, such terms equally identify knitting machines whose guide bars may be referred to as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

According to the method of the present invention, one yarn guide bar of the warp knitting machine utilized is fitted with a pile loop forming device of the aforedescribed conventional type providing sinker members over which the underlap loops of a set of pile yarns are formed to a controlled extended pile height. A representative example of such a device is disclosed in U.S. Pat. No. 4,003,222 to Wunner. As used herein, the term "pile loop forming device" is intended to encompass generically all such devices and all equivalent mechanisms presently known or hereafter developed.

Figure 1:
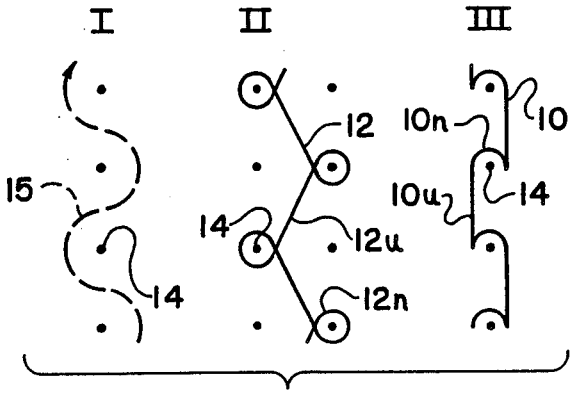
FIG. 1 is a diagram showing individually the stitch patterns for the ground and pile yarns and the cooperative pattern of the pile loop forming device carried out by a warp knitting machine in knitting one preferred embodiment of the present fabric according to the method of the present invention.
Figure 2:
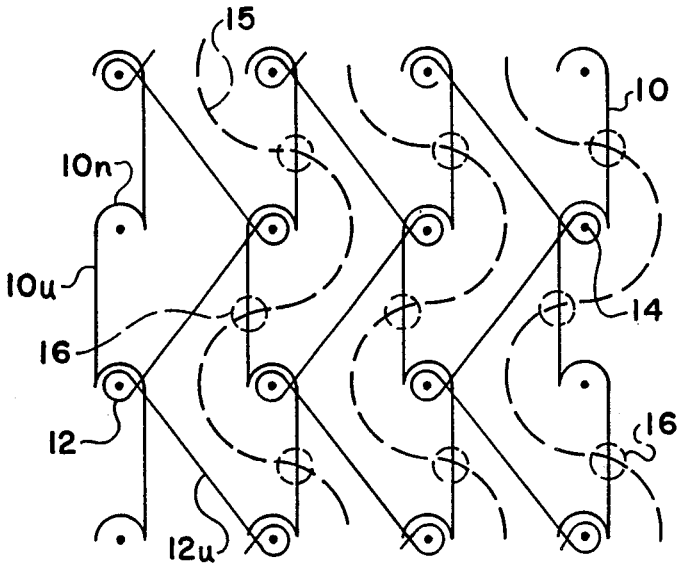
FIG. 2 is a composite diagram thereof.
Figure 3:
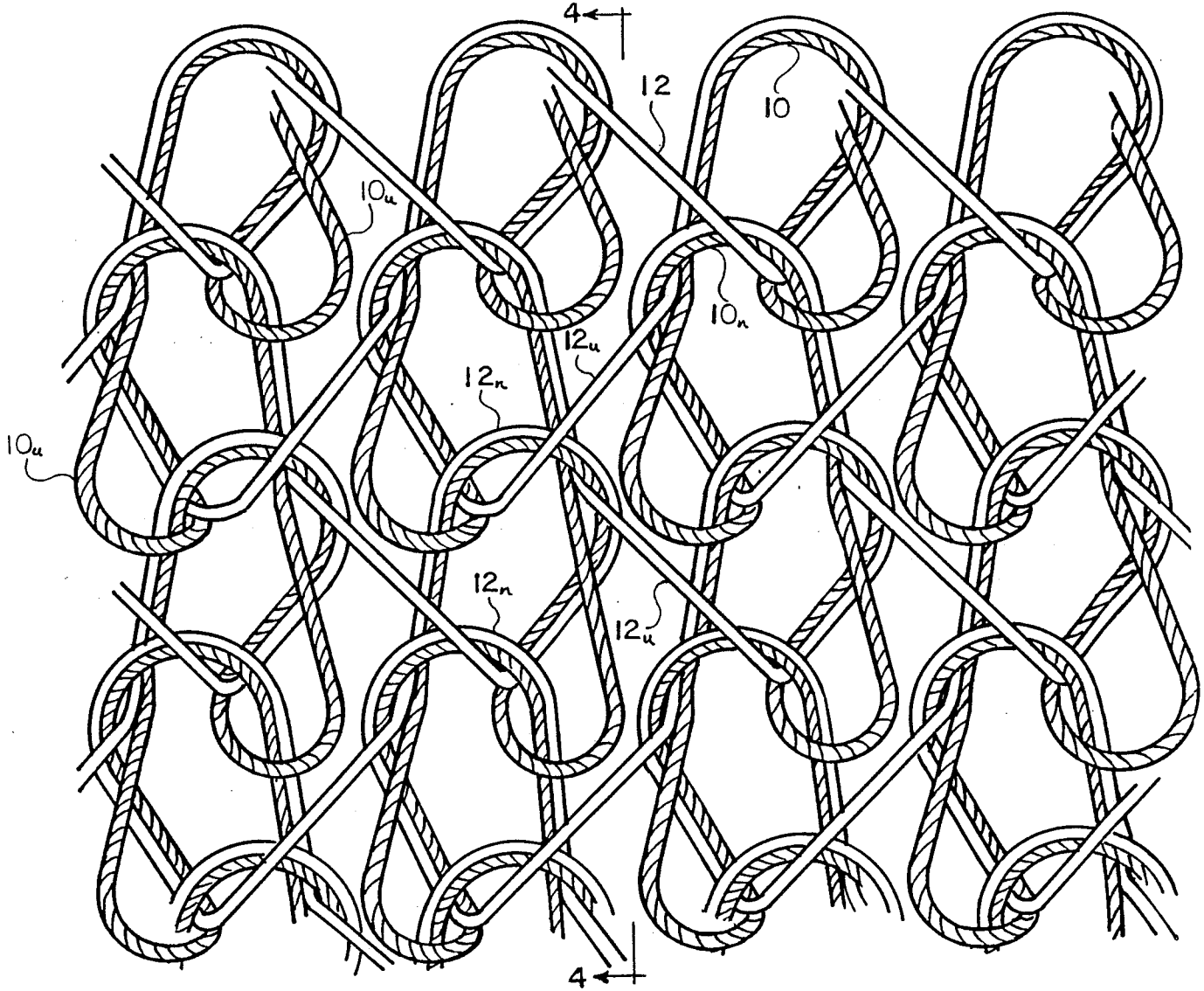
FIG. 3 is an enlarged schematic plan view of the resultant fabric produced according to the diagrams of FIGS. 1 and 2, shown from the technical back of the fabric.

Referring now to the accompanying drawings and initially to FIGS. 1–3, one particular embodiment of the present warp knitted fabric of a two bar construction knitted according to the present method on a three bar warp knitting machine, is illustrated. According to this embodiment, the top guide bar of the machine is fully supplied with a set of pile yarns 10 delivered from a warp beam (not shown), while the middle yarn guide bar is fully supplied with a set of ground yarns 12 from another warp beam (also not shown). The bottom guide bar of the machine is not supplied with yarn but instead is fitted with the aforedescribed pile loop forming device for cooperation of its sinker members with the pile yarns 10 fed by the top guide bar. Preferably, the pile yarns 10 are relatively heavier denier, multi-filament yarns, e.g., a multi-filament polyester or nylon yarn in the range of 60–75 denier, with the ground yarns 12 being relatively finer denier, monofilament yarns, e.g., a 20 denier monofilament nylon yarn. Of course, those persons skilled in the art will recognize that other types and sizes of yarns may also be employed as desired. For instance, either monofilament, multifilament or other types of yarns may be used for the pile and ground yarns and the selected pile and ground yarns may be of essentially any denier or selected from substantially any range of deniers provided that the pile yarn is relatively heavier, as may be necessary or desirable for varying particular fabric constructions.

In FIGS. 1 and 2, the stitch constructions of the pile and ground yarns 10,12 and the cooperative tracking movement of the sinker members of the pile loop forming device carried out by the respective lateral traversing movements of the guide bars of the knitting machine are respectively illustrated individually and compositely in a traditional dot diagram format, wherein the individual dots 14 represent the needles of the needle bar of the knitting machine in the formation of several successive fabric courses C across several successive fabric wales W. According to this embodiment, the top guide bar of the machine manipulates the pile yarns 10 to traverse laterally back and forth relative to the needles 14 of the needle bar of the machine to stitch the pile yarns 10 in a repeating 1,0-0,1 chain stitch pattern, as indicated at III. Simultaneously, the middle guide bar of the knitting machine manipulates the ground yarns 12 to traverse relative to the needles 14 to stitch the ground yarns 12 in a repeating 1,0-1,2 tricot jersey stitch pattern, as indicated at II. At the same time, the bottom guide bar of the machine reciprocates the pile loop forming device to move its sinker members back and forth in a one needle traverse, indicated by the broken line 15 at I, to continuously evade the simultaneous traversing motion of the middle guide bar II to avoid loop-forming engagement of the sinker members with the ground yarn 12, while facilitating placement of the float or underlap portions $\mathbf{10}_u$ of the pile yarns 10 over the sinker members of the pile loop forming device at cross-over points indicated at 16, thereby constraining the pile yarns 120, but not the ground yarns 12, to form extended underlap loops thereof. The respective simultaneous stitch patterns of the pile and ground yarns 10,12 and the traversing pattern of the pile loop forming device is shown in a composite dot diagram in FIG. 2, wherein the cross-over points 16 will be clearly seen and understood.

Figure 4:
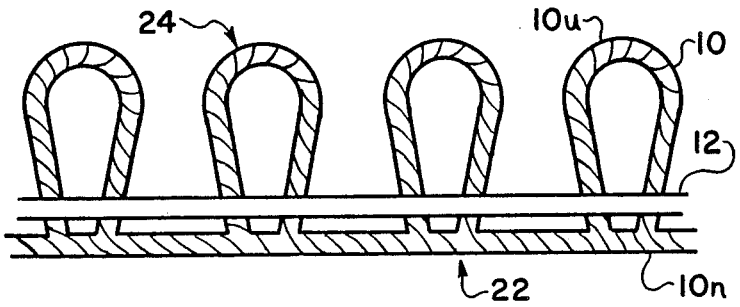
FIG. 4 is a schematic cross-sectional view of the fabric of FIG. 3 taken generally along line 4—4 thereof.

The resultant warp knitted fabric is shown diagrammatically in FIG. 3 from the technical back, or underlap, side of the fabric in the construction of the fabric as it is removed from the warp knitting machine prior to any further processing. The ground yarns 12 are interknitted with one another in the aforementioned tricot jersey stitch construction with each ground yarn 12 being formed in needle loops $\mathbf{12}_n$ alternating every course C between a pair of adjacent vertical fabric wales W and in connecting underlap loops $\mathbf{12}_u$ extending diagonally between the successive needle loops $\mathbf{12}_n$. The pile yarns 10 are formed in respective wales W in needle loops $\mathbf{10}_n$ aligned walewise with one another and interknitted in plated relationship with the ground yarn needle loops $\mathbf{12}_n$ in the respective wales and in elongated pile underlap loops $\mathbf{10}_u$ extending in the respective wales between the successive needle loops $\mathbf{10}_n$, but the pile yarns 10 are not interknitted with each other due to their chain stitch construction. As will thus be understood, the ground yarns 12 form a base or substrate to the fabric with the needle loops $\mathbf{10}_n$ of the pile yarn 10 appearing outwardly of the ground yarn needle loops $\mathbf{12}_n$ at the technical face 22 of the fabric forming a generally smooth fabric surface and with the elongated pile underlap loops $\mathbf{10}_u$ of the pile yarn 10 appearing outwardly of the ground yarn 12 at the technical back 24 of the fabric to produce a terry-like pile fabric surface. In this manner, the pile yarn 10 provides a dual facing to the fabric which substantially completely conceals the ground yarn substrate, as is schematically illustrated in FIG. 4.

Figure 5:
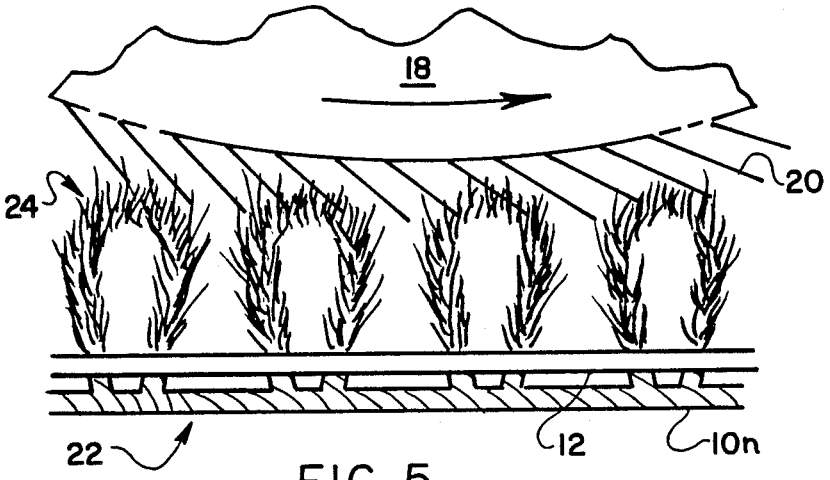
FIG. 5 is another schematic cross-sectional view, similar to FIG. 4, representatively showing the fabric of FIG. 3 as napped on its technical back.
Figure 6:
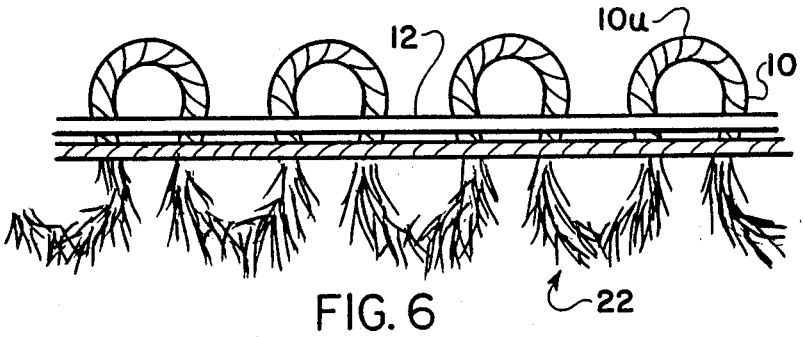
FIG. 6 is another schematic cross-sectional view, similar to FIG. 4, representatively showing the fabric of FIG. 3 as napped on its technical face.
Figure 7:
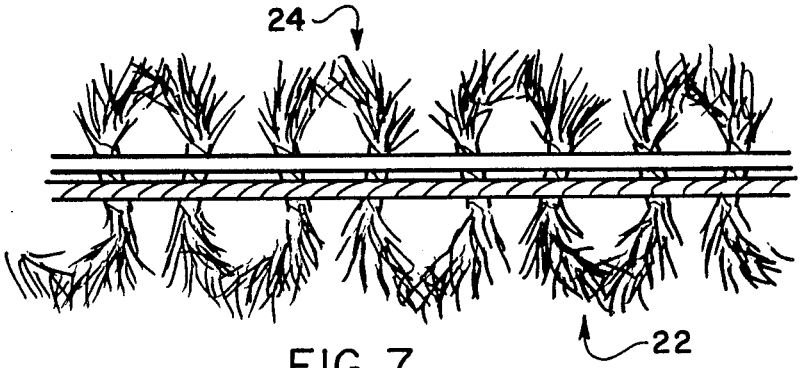
FIG. 7 is another schematic cross-sectional view, similar to FIG. 4, representatively showing the fabric of FIG. 3 as napped on both its technical face and back.
Figure 8:
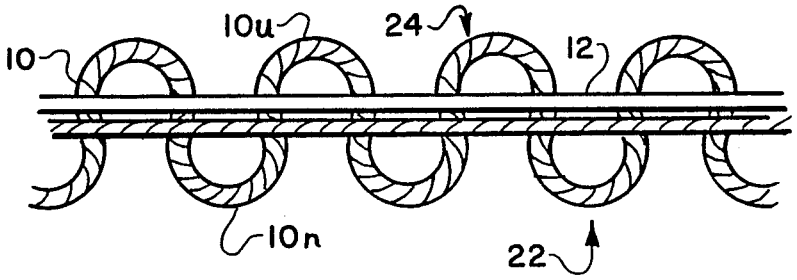
FIG. 8 is another schematic cross-sectional view, similar to FIG. 4, representatively showing the fabric of FIG. 3 as napped only by a raised loop napping treatment on its technical face.

In contrast to the conventional wisdom in the warp knitting art that a non-pile constructed technical face of a warp knitted fabric cannot be fully napped without damaging the structural integrity of the fabric, it has been discovered that the extended pile loop construction of the technical back 24 of the present fabric effectively provides a stored supply of the pile yarn 10 which may be partially drawn from the technical back 24 of the fabric through the substrate to the technical face 22 by napping treatment of the pile yarn needle loops $\mathbf{10}_n$ on the technical face 22 of the fabric. Accordingly, the present fabric of FIGS. 1–4 uniquely provides nappable surfaces at both the technical face 22 and the tehchical back 24 of the fabric with only a two-bar fabric construction as described. As such, the fabric of the present invention may be processed by napping on either or both faces of the fabric to facilitate the finishing of the fabric in at least four different napped forms, illustrated in FIGS. 5–8 as well as the unnapped construction of the fabric as produced by the warp knitting machine, as shown in FIG. 4. As illustrated in FIG. 5, the elongated pile underlap loops $10_u$ of the pile yarn 10 at the technical back 24 of the fabric may be napped by any conventional napping mechanism or process, such as by a conventional napping cylinder 18 clothed with conventional card wire 20 as representatively shown in FIG. 5, to partially brush the filaments of the pile yarn 10 in the underlap loops $10_u$ to produce a raised velvet-like plush surface effect on the technical back 24 of the fabric, with the unnapped technical face 22 of the fabric remaining generally smooth. Alternatively, as shown in FIG. 6, the needle loops $10_n$ of the pile yarn 10 at the technical face 22 of the fabric may be similarly napped by a napping cylinder 18. Unexpectedly, as the napping engagement of the pile yarn needle loops $10_n$ progresses, the pile yarn 10 in the connecting underlap loops $10_u$ at the technical back 24 of the fabric is partially drawn through the ground yarn substrate of the fabric to the technical face 22 to supply a sufficient excess of the pile yarn 10 at the technical face 22 to enable the filaments of the pile yarn 10 and the needle loops $10_n$ to be partially raised to produce a similar plush velvet-like surface effect on the technical face 22 of the fabric. Notably, the underlap loops $10_u$ are not fully drawn through the fabric substrate so that the technical back of the fabric continues to have a terry-like pile surface construction, although of a reduced pile height. Further, as shown in FIG. 7, the extended underlap loops $10_u$ of the pile yarn 10 supply a sufficient stored quantity of the pile yarn 10 to enable both the technical face 22 and technical back 24 of the fabric to be subjected to napping operations and, importantly, the underlap loops $10_u$ may be sufficiently drawn through the fabric substrate to the technical face 22 so that its napped surface is of a comparable plush thickness to that of the technical back 24. Finally, as desired, the technical face 22 of the fabric may be subjected to only a so-called "raised loop" napping treatment sufficient only to partially draw the underlap loops $10_u$ of the pile yarn 10 to the technical face without a significant degree of brushing of the yarn filaments to leave them essentially intact to produce a terry-like like raised pile surface effect on the technical fabric face 22 comparable to the terry-like surface of the technical fabric back 24, as illustrated in FIG. 8.

The present fabric and the method of knitting it according to the present invention provide several significant advantages. First, the fabric provides dual nappable or napped faces while being of only a two-bar construction knitted from only two sets of warp yarns which, as those persons skilled in the art will understand, is not possible through the use of conventional warp knitting technology such as the overfeeding technique described above in the Background section. As a result, the fabric is sufficiently lightweight to be suitable for substantially any apparel uses requiring a plush or fleece-type fabric. Particularly, the specific fabric construction shown in FIGS. 1–3 advantageously provides a high degree of coursewise stretchability due to the chain stitch construction of the pile yarn to provide enhanced comfort as well as good moldability and drapability of the fabric to facilitate a significant range of other uses beyond apparel uses. From a structural standpoint, the chain stitch construction of the pile yarns maximizes the amount of pile yarn which may be stored in the elongated underlap loops $10_u$ while minimizing the overall amount of the pile yarns utilized in the fabric. Accordingly, the present fabric is significantly less expensive than conventional three-bar warp knitted fabric constructions required to provide nappability on both fabric faces. Further, the use of the pile loop forming device allows precise control of yarn tension to permit the formation of more extended pile loops than can be accomplished by conventional overfeeding techniques while also thereby enabling the use of virtually any type of yarn in carrying out the present invention, particularly relatively strong filament yarns such as polyester and nylon which characteristically resist knitting by any overfeeding method. Finally, the ability of the present fabric to be selectively napped on either or both surfaces enables the fabric producer to exercise a considerable degree of flexability in varying the feel and appearances of the fabric without modifying the knitted construction of the fabric or the knitting machine, as is well exemplified by the various fabric forms shown in FIGS. 4–8 discussed above.

Of course, as those persons skilled in the art will readily recognize, the possible variations in fabric construction and methods of knitting fabrics according to the present invention are virtually limitless. By way of example but without limitation, a number of alternative fabric constructions and knitting methods are illustrated in FIGS. 9–20. Specifically, FIGS. 9 and 10, FIGS. 11 and 12, and FIGS. 13 and 14, illustrate alternative two-bar fabric constructions which may be knitted on warp knitting machines of the same three-bar construction as the fabric of FIGS. 1–3. In the fabric of FIGS. 9 and 10, a full set of ground yarns 12 are manipulated by the middle guide bar II in a tricot jersey stitch construction and the pile loop forming device is manipulated by the bottom bar I in a one needle traverse identically as in the above-described knitting method by which the fabric of FIGS. 1–3 is formed. The top guide bar III, on the other hand, manipulates a full set of pile yarns 10 in a 1,0-3,4 stitch construction so that each pile yarn underlap loop $10_u$ crosses over a pair of pile loop forming sinker members at two points 16 to produce a considerably greater lateral coursewise extent to the extended underlap loops $10_u$. In contrast to the fabric construction of FIGS. 1–3, the pile yarns 10 in the fabric of FIGS. 9 and 10 are interknitted with one another which, in conjunction with the significant lateral coursewise extent of the underlap pile loops $10_u$, provides a greater degree of lateral coursewise stability to the fabric, while permitting greater walewise stretchability.

Figure 12:
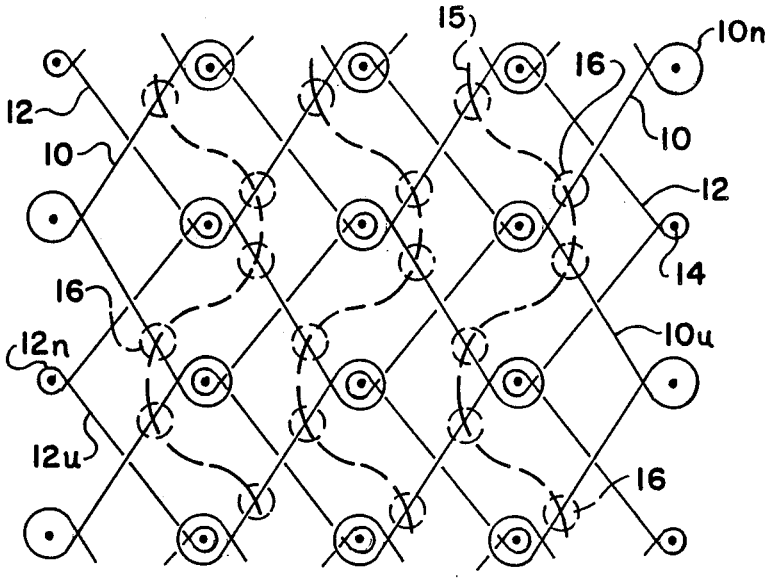
FIG. 12 is a composite diagram thereof.

In FIGS. 11 and 12, the fabric and method of the present invention are illustrated for the knitting of a so-called double tricot fabric wherein a full set of ground yarns 12 are manipulated by the middle bar II in the same 1,0-1,2 tricot jersey stitch construction as the fabric of FIGS. 1–3 while a full set of pile yarns 10 are manipulated by the top bar III in a reverse 1,2-1,0 tricot jersey stitch construction. The pile loop forming device is manipulated by the bottom guide bar I in the same one needle traverse as the knitting method of FIGS. 1–3, whereby each underlap loop $10_u$ of the pile yarn 10 crosses over two pile loop sinker members at points 16. As will be understood, this fabric construction provides comparable stretchability in both walewise and coursewise directions.

Figure 13:
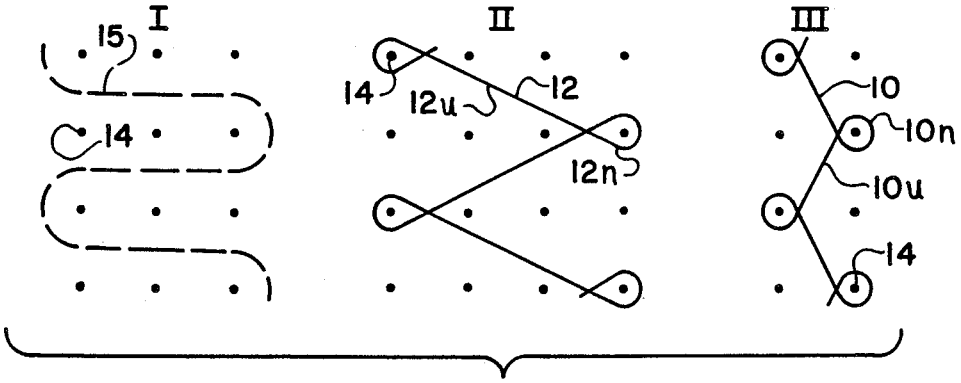
FIG. 13 is another diagram similar to FIG. 1 individually showing the stitch patterns of the ground and pile yarns and the cooperative pattern of the pile forming device carried out by a warp knitting machine in knitting a fourth embodiment of the present fabric according to the method of the present invention.
Figure 14:
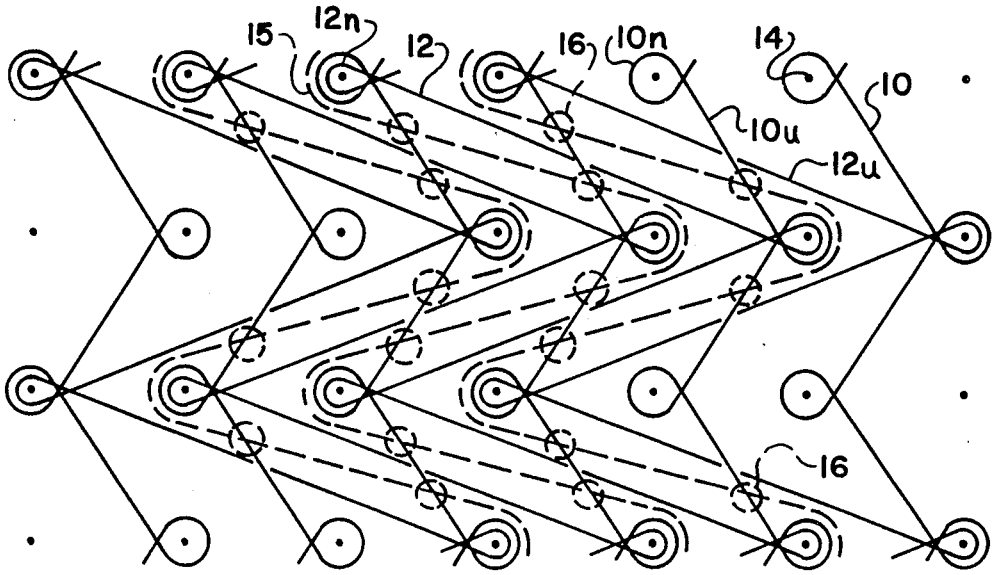
FIG. 14 is a composite diagram thereof.
Figure 15:
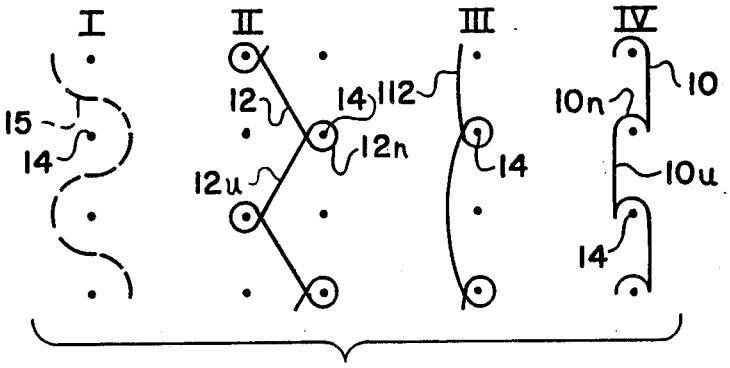
FIG. 15 is another diagram similar to FIG. 1 showing individually the stitch patterns of two ground yarns and a pile yarn and the cooperative pattern of the pile loop forming device carried out by a warp knitting machine in knitting a fifth embodiment of the present fabric according to the method of the present invention.
Figure 16:
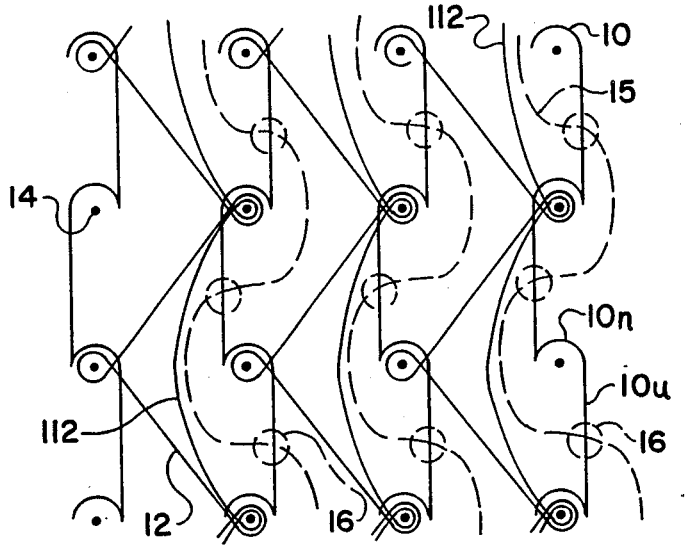
FIG. 16 is a composite diagram thereof.

In the embodiment of FIGS. 13 and 14, a full set of ground yarns 12 are manipulated by the middle guide bar II in a 1,0-3,4 stitch pattern while a full set of pile yarns 10 are manipulated by the top guide bar III in a 1,0-1,2 tricot jersey stitch pattern. Due to the extended four needle traverse of the middle guide bar II, the bottom guide bar I is manipulated to provide a three needle traversing movement to the pile loop forming device tracking the traverse of the middle bar II in order that the sinker members of the pile loop forming device evade the middle bar II to avoid the formation of the connecting underlap loops of the ground yarns 12 over the sinker members. In this manner, each underlap loop $10_n$ of each pile yarn 10 crosses over two sinker members of the pile loop forming device at points 16. As will be understood, this fabric construction also provides a greater degree of lateral coursewise stability to the fabric due to the lateral extent of the underlap loops $12_u$ of the groubnd yarns 12, while providing a greater degree of walewise stretchability.

Of course, it will also be understood that the present invention may be carried out on warp knitting machines of a four bar or greater construction and, as desired, an additional set of ground yarns and/or pile yarns may be employed, representative examples of such fabric construction and knitting methods being shown in FIGS. 15 and 16, FIGS. 17 and 18, and FIGS. 19 and 20, respectively. In the fabric and method illustrated in FIGS. 15 and 16, two full sets of ground yarns 12,112 are fed respectively by the two middle bars II,III and a single full set of pile yarns 10 are fed by the top bar IV of a four bar warp knitting machine, with the pile loop forming device being mounted on the bottom bar I. The ground yarns 12 are manipulated by the middle bar II in a 1,0-1,2 tricot jersey stitch pattern while the ground yarns 112 are manipulated by the middle bar III in a 1,0-1,1 stitch pattern to be knitted only in alternate courses, with the pile loop forming device being cooperatively manipulated by the bottom bar I in a one needle traverse to evade the traversing movements of both middle bars II and III. The pile yarns 10 are manipulated by the top bar IV in a 1,0-0,1 chain stitch pattern. As will be understood, this fabric construction provides comparable lateral coursewise stretchability to that of the fabric embodiment of FIGS. 1–3 inasmuch as the ground yarns 112 and the pile yarns 10 are not interknitted with the other ground and pile yarns 112,10, while the ground yarns 112 enhance the walewise stability of the fabric and provide additional weight and thickness thereto. The nappability of both faces of the fabric and the resultant plushness thereof are essentially the same as the fabric of FIGS. 1–3.

Figure 17:
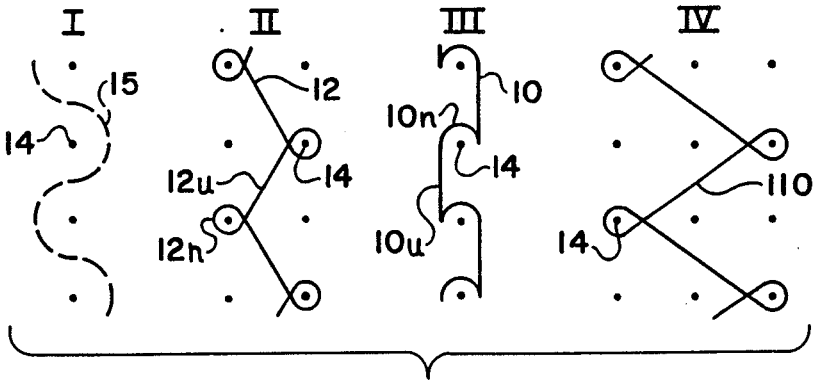
FIG. 17 is another diagram similar to FIG. 1 showing individually the stitch patterns of a ground yarn and two pile yarns and the cooperative pattern of the pile loop forming device carried out by a warp knitting machine in knitting a sixth embodiment of the present fabric according to the method of the present invention.
Figure 18:
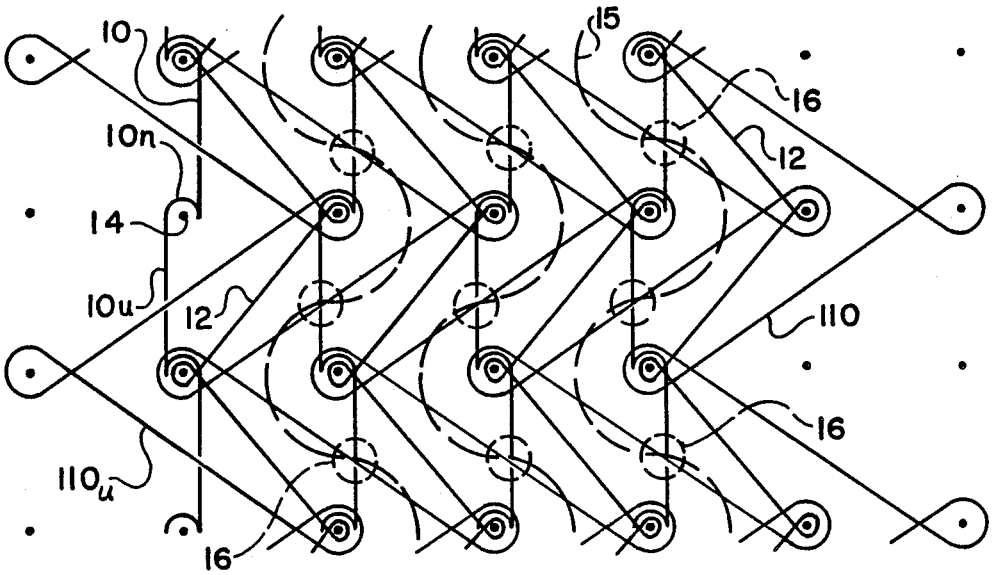
FIG. 18 is a composite diagram thereof.

In the fabric and knitting method illustrated in FIGS. 17 and 18, two full sets of pile yarns 10,110 are fed respectively by the top yarn guide bar IV and the next uppermost bar III while a single full set of ground yarns 12 are fed by the next adjacent middle bar II of a four bar knitting machine, with the pile loop forming device being fitted on the bottom bar I. The ground yarns 12 are again manipulated by the lower middle bar II in a 1,0-1,2 tricot jersey stitch pattern, with the pile loop forming devices being cooperatively manipulated by the bottom bar I in a one needle traverse. The pile yarns 10 are manipulated by the upper middle bar III in a 1,0-0,1 chain stitch pattern, while the pile yarns 110 are manipulated by the top bar IV in a 1,0-2,3 stitch pattern. As will be understood, the two sets of pile yarns 10,110 provide an increased amount of nappable underlap loops $10_u$, $110_u$ to provide increased thickness and plushness to the napped fabric surface or surfaces, while the extent of the underlap provided by the stitch pattern of the second set of pile yarns 110 enhances the lateral coursewise stability to the fabric.

Figure 19:
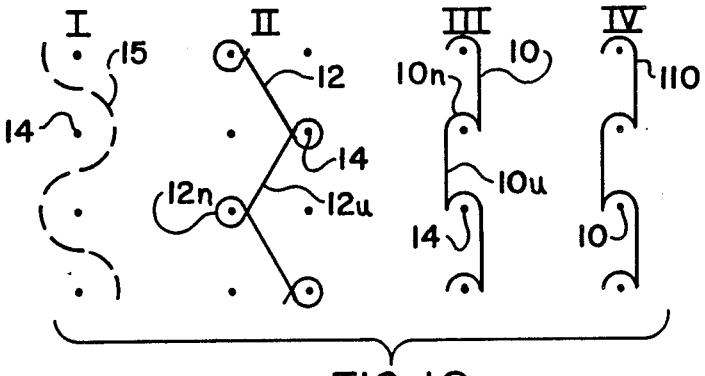
FIG. 19 is another diagram similar to FIG. 1 individually showing the stitch patterns of a ground yarn and two pile yarns and the cooperative pattern of the pile loop forming device carried out by a warp knitting machine in knitting a seventh embodiment of the present fabric according to the method of the present invention.
Figure 20:
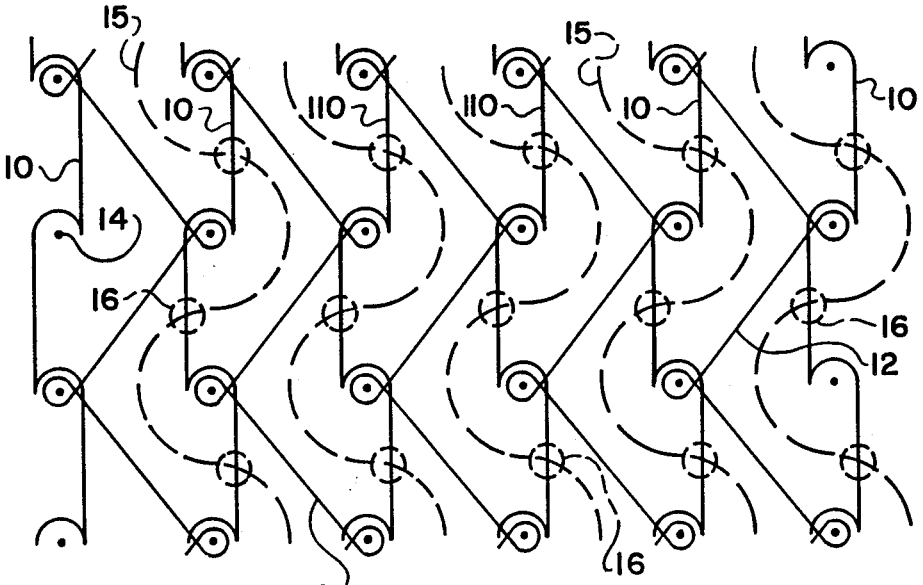
FIG. 20 is a composite diagram thereof.

FIGS. 19 and 20 illustrate an embodiment of knitted fabric and knitting method wherein two sets of pile yarns 10,110, each including approximately half the total number of yarns for which the guide bars of the knitting machine have capacity, are fed respectively by the top guide bar IV and the next uppermost guide bar III while a single full set of ground yarns 12 are fed by the next adjacent middle bar II, with the pile loop forming device being fitted on the bottom bar I. The two sets of pile yarns 10,110 have differing characteristics from one another, e.g., differing colors, surface textures, dye affinities, etc. and, accordingly, are fed by their respective guide bars III,IV in a predetermined walewise pattern relative to one another, e.g., an alternating relationship such as alternating pairs of the pile yarns 10,110 shown in FIG. 20. The two sets of pile yarns 10,110 are manipulated by their respective guide bars III,IV in identical 1,0-0,1 chain stitch patterns, while the ground yarns 12 are manipulated by the guide bar II in a 1,0-1,2 tricot jersey stitch pattern with the pile loop forming devices being cooperatively manipulated by the bottom bar I in a one needle traverse. Accordingly, the resultant knitted fabric is identical in construction to the fabric of FIGS. 1–3, but due to the differing characteristics of the two sets of pile yarns 10,110 the fabric achieves a walewise striped pattern effect. Those persons skilled in the art will readily recognize the substantial patterning possibilities available with the present fabric and knitting method by the selective use of two or more sets of differing warp yarns and the selective variation of stitch patterns.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method of producing a warp knitted fabric of at least two bar construction having a nappable surface on both the technical face and the technical back of said fabric, said method comprising:

providing a warp knitting machine having at least top, middle and bottom yarn guide bars with pile loop forming means mounted on said bottom bar;

warp knitting a set of ground yarns on said middle bar of said machine to form a fabric substrate;

simultaneously warp knitting a set of pile yarns on said top bar of said machine and over said pile loop forming means on said bottom bar to knit said pile yarns into said substrate in needle loops at the technical face of said fabric forming a first nappable surface and in elongated pile underlap loops at the technical back of said fabric forming a second nappable surface;

said underlap loops being nappable to produce a plush surface on the technical back of said fabric and being further adapted to be partially drawn sufficiently from the technical back of said fabric through said substrate to the technical face of said fabric into said needle loops upon napping of said needle loops to render said needle loops nappable to produce a plush surface at the technical face of said fabric of a comparable thickness to the technical back of said fabric; and then napping at least one of said nappable surfaces.

2. A method of producing a warp knitted fabric according to claim 1, and characterized further in that said napping step comprises napping only said first nappable surface to produce a plush surface on the technical face of said fabric and a terry loop surface on the technical back of said fabric.

3. A method of producing a warp knitted fabric according to claim 1, and characterized further in that said napping step comprises napping only said first nappable surface only to the extent necessary to produce a raised loop terry-like surface effect to provide said fabric with a dual-faced terry pile construction.

4. A method of producing a warp knitted fabric according to claim 1, and characterized further in that said napping step comprises napping only said second nappable surface to produce a plush surface on the technical back of said fabric and a smooth surface on the technical face of said fabric.

5. A method of producing a warp knitted fabric according to claim 1, and characterized further in that said napping step comprises napping each said nappable surface to produce plush surfaces of comparable thicknesses on both the technical face and technical back of said fabric.

6. A method of producing a warp knitted fabric according to claim 1, and characterized further by warp knitting said ground yarns in a 1,0-1,2 stitch pattern and warp knitting said pile yarns in a 1,0-0,1 chain stitch pattern.

7. A method of producing a warp knitted fabric according to claim 1, and characterized further by warp knitting a second set of ground yarns on another middle bar of said machine to form a second fabric substrate in a different stitch pattern from said first set of ground yarns.

8. A method of producing a warp knitted fabric according to claim 1, and characterized further by warp knitting a second set of pile yarns into said fabric substrate in a different stitch pattern from said first set of pile yarns.

9. A method of producing a warp knitted fabric according to claim 1, and characterized further by warp knitting a second set of pile yarns into said fabric substrate in an alternating relationship with said first set of pile yarns, said second set of pile yarns being of a differing characteristic from said first set of pile yarns.

10. A method of producing a warp-knitted fabric according to claim 1, and characterized further in that said ground yarns are relatively fine denier mono-filament yarns and said pile yarns are relatively heavy denier multi-filament yarns.

* * * * *